US007043951B2

(12) United States Patent
Suzuki et al.

(10) Patent No.: US 7,043,951 B2
(45) Date of Patent: May 16, 2006

(54) WIRE ROD-FORMING MACHINE

(75) Inventors: Takashi Suzuki, Owariasahi (JP); Shigeo Nishimura, Owariasahi (JP); Eiichi Kobayashi, Miyota-Machi (JP); Kazunori Sawayama, Miyota-Machi (JP)

(73) Assignees: Minebea Co. Ltd, Nagano (JP); Asahi - Seiki Manf. Co., Aichi (JP)

( * ) Notice: Subject to any disclaimer, the term of this patent is extended or adjusted under 35 U.S.C. 154(b) by 257 days.

(21) Appl. No.: 10/719,478

(22) Filed: Nov. 21, 2003

(65) Prior Publication Data

US 2004/0148993 A1 Aug. 5, 2004

(30) Foreign Application Priority Data

Nov. 26, 2002 (JP) ..... 2002-342699

(51) Int. Cl.
*B21F 11/00* (2006.01)

(52) U.S. Cl. ..... 72/129; 72/132; 72/134; 140/88

(58) Field of Classification Search ..... 72/129, 72/134; 140/88
See application file for complete search history.

(56) References Cited

U.S. PATENT DOCUMENTS

| | | | | |
|---|---|---|---|---|
| 4,090,383 | A | 5/1978 | Properzi | |
| 4,173,235 | A * | 11/1979 | Tipper | 140/82 |
| 4,335,758 | A * | 6/1982 | Williams | 140/88 |
| 4,823,576 | A * | 4/1989 | Yoshioka | 72/11.1 |
| 6,565,031 | B1 | 5/2003 | Haak | |
| 6,568,056 | B1 | 5/2003 | Sclippa | |
| 6,748,781 | B1 | 6/2004 | Felgen | |

* cited by examiner

*Primary Examiner*—Derris H. Banks
*Assistant Examiner*—Debra Wolfe
(74) *Attorney, Agent, or Firm*—John J. Skinner, Jr.; Joel E. Lutzker; Schulte Roth & Zabel

(57) ABSTRACT

To provide a wire rod forming machine for which it is possible to increase the production speed above that of the prior art. In the ring-forming machine 10 of the present configuration, between the respective edges 42 and 51 of the moving die 40 and the fixed punch 50, a prescribed location of the belt-shaped wire rod 90 is sheared and the ring 91 is cut off from the belt-shaped wire rod 90. Then, by pushing the ring 91 that was cut off with the moving die 40, the ring is forcibly removed from the forming tools 31, 32 and 33. Therefore, the speed of removal of the ring 91 can be coupled to the acceleration of the manufacturing speed and increased, allowing the production speed to be improved compared to that of the prior art. In addition, since the ring 91 that is cut off from the belt-shaped wire rod 90, pushed by the moving die 40, moves to the end side of the shaft shaped chute 34 to be collected, transport to the next process becomes easy.

14 Claims, 14 Drawing Sheets

[Fig. 1]
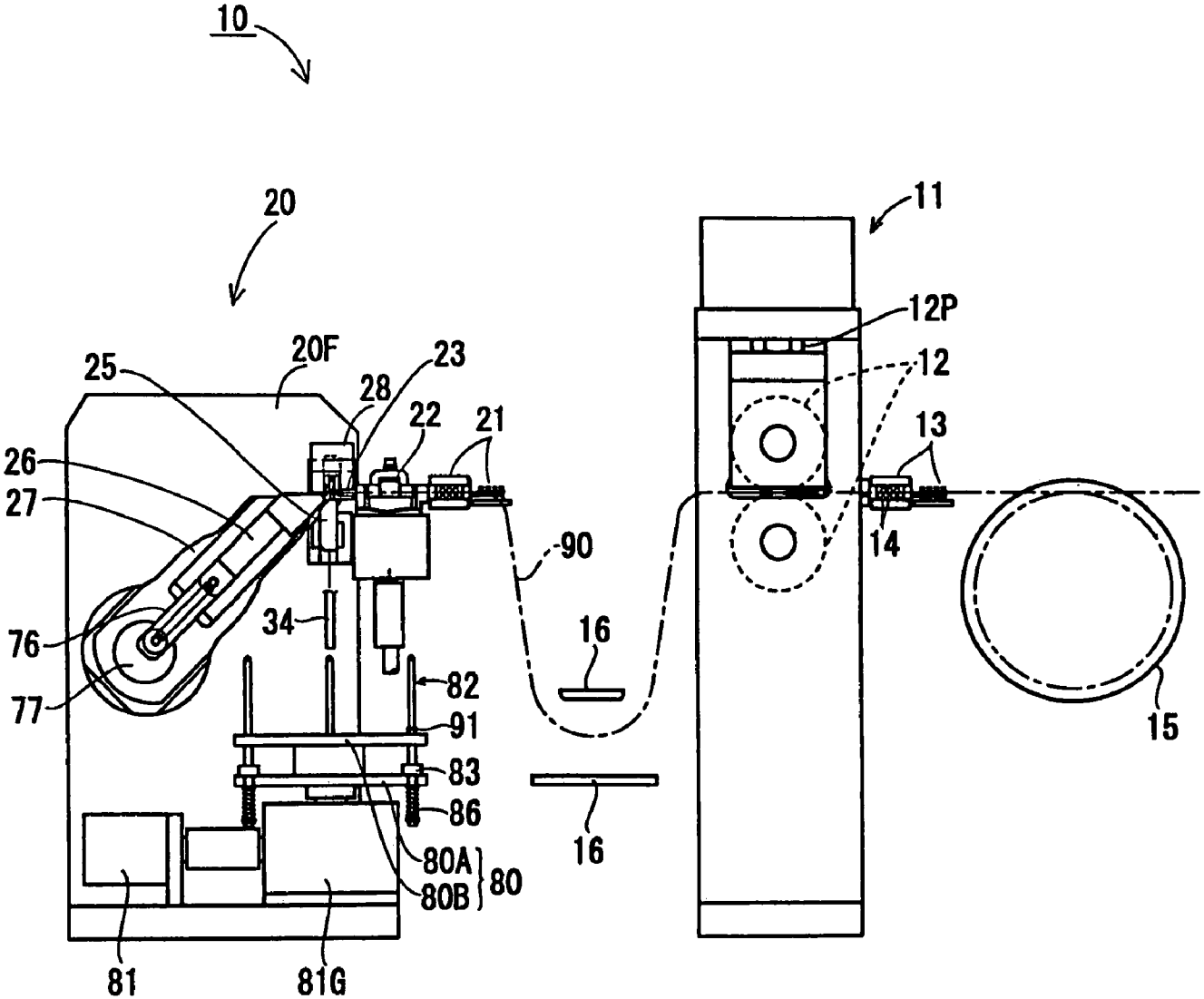

[Fig. 2]
(A)
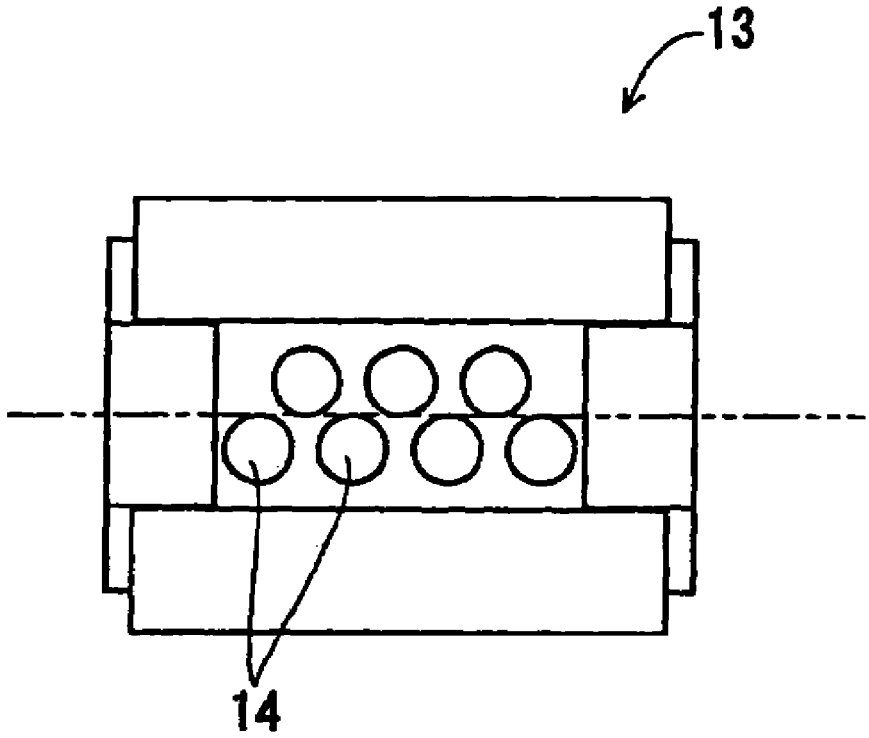
(B)
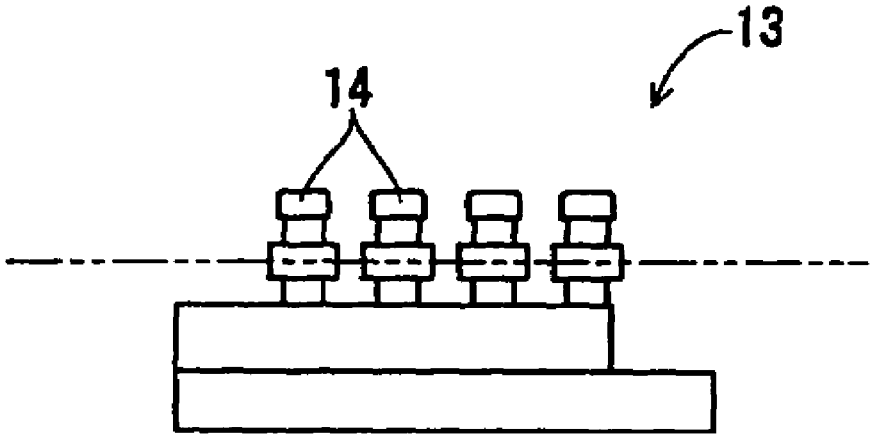

[Fig. 3]
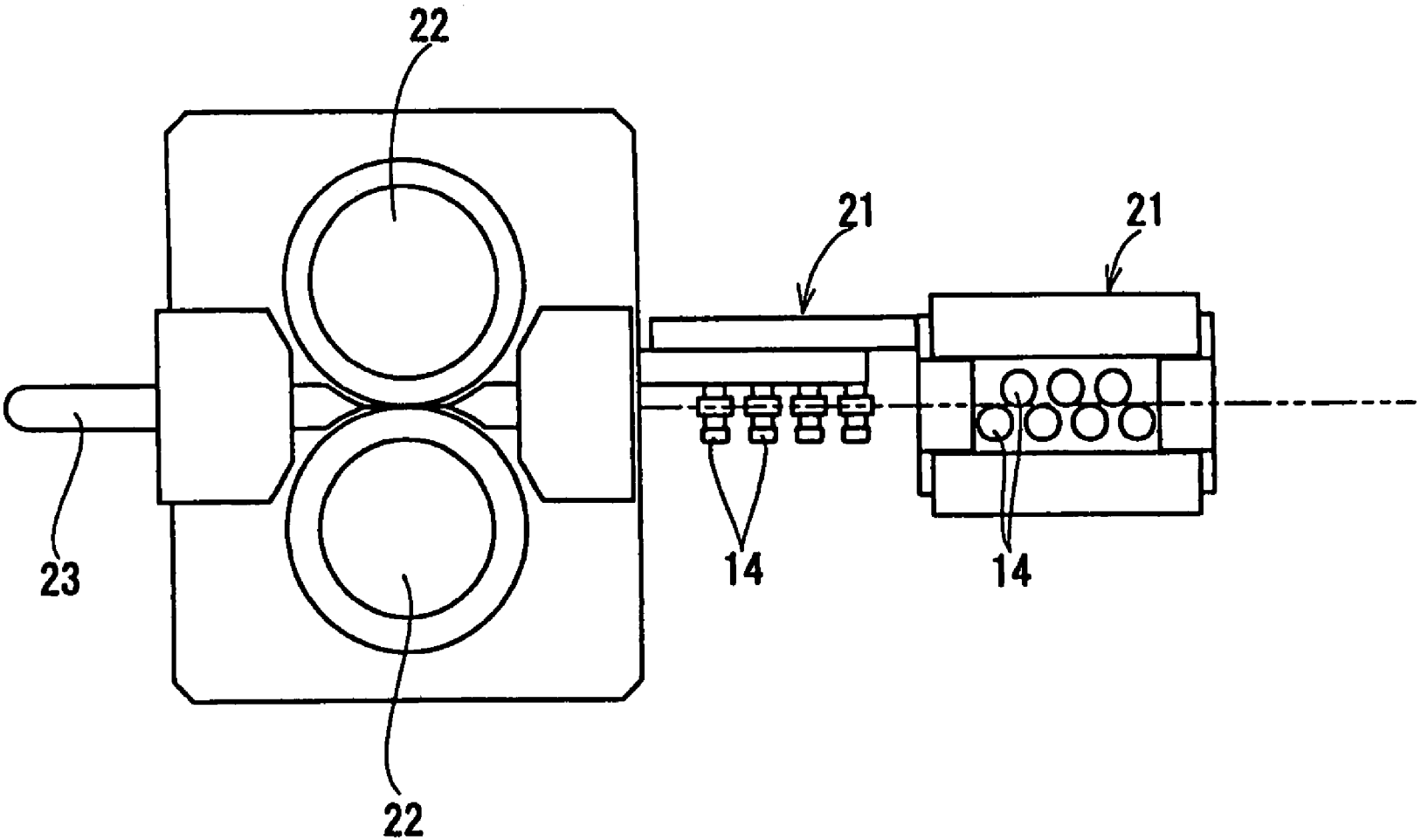

[Fig. 4]
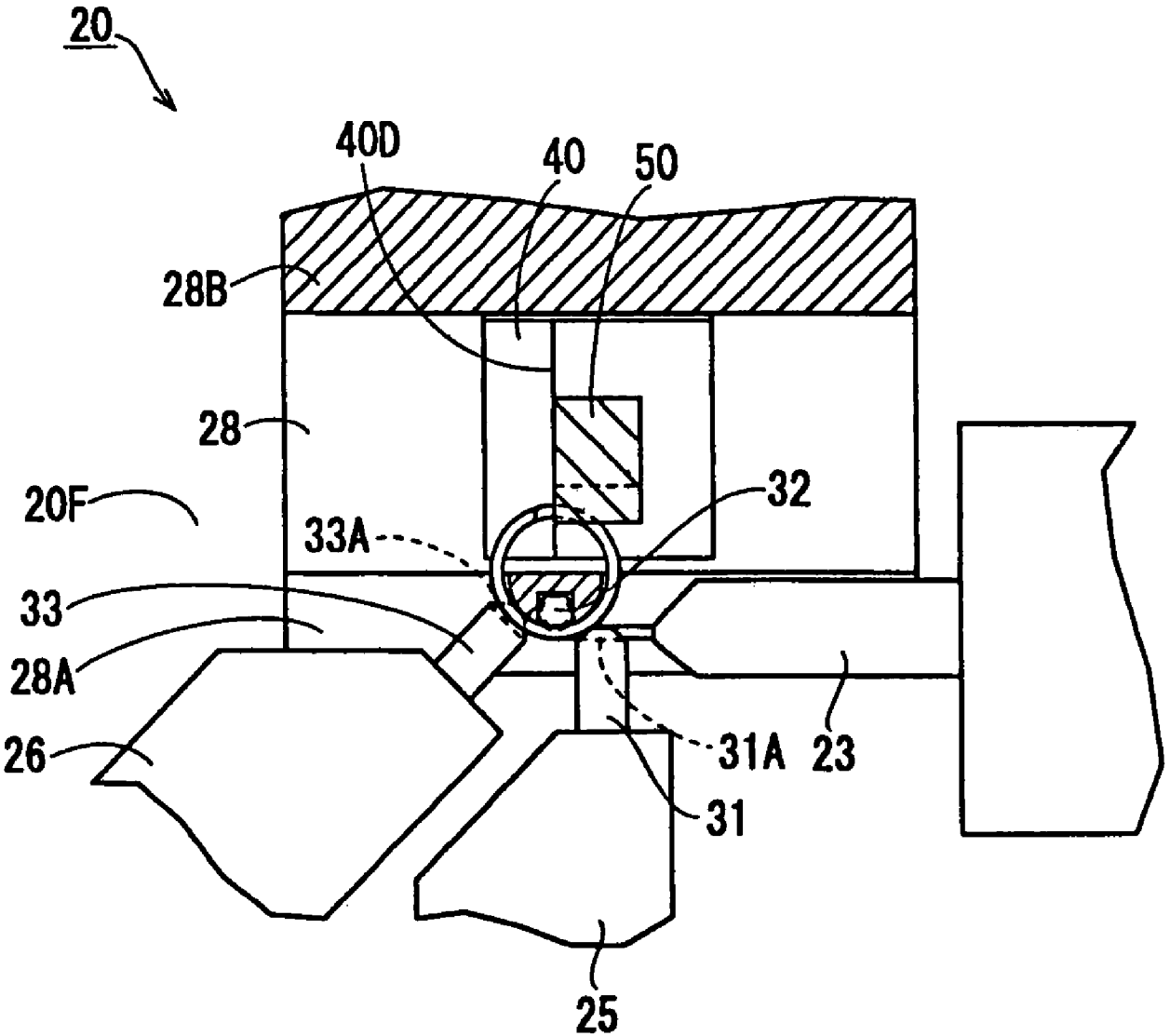

[Fig. 5]
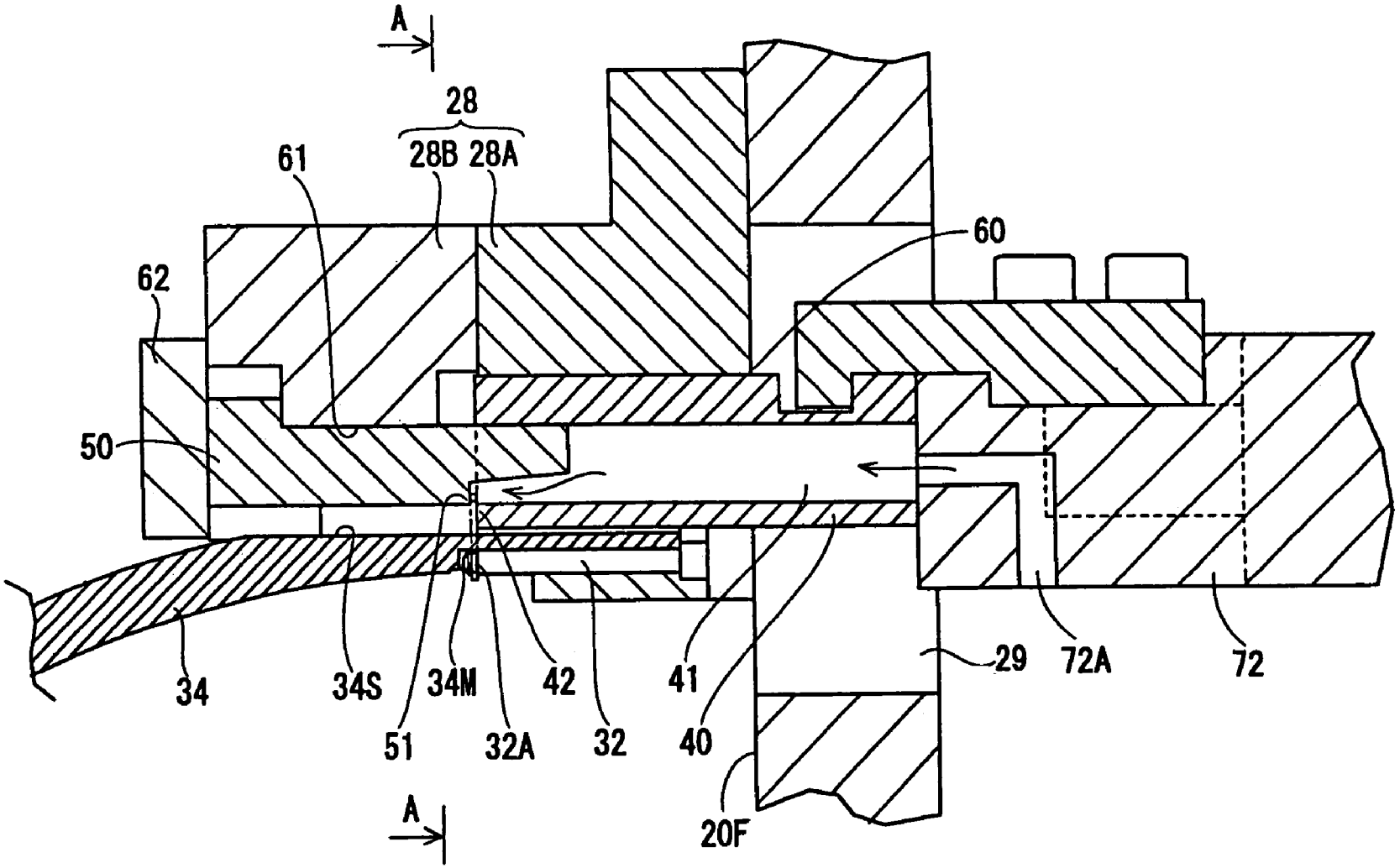

[Fig. 6]
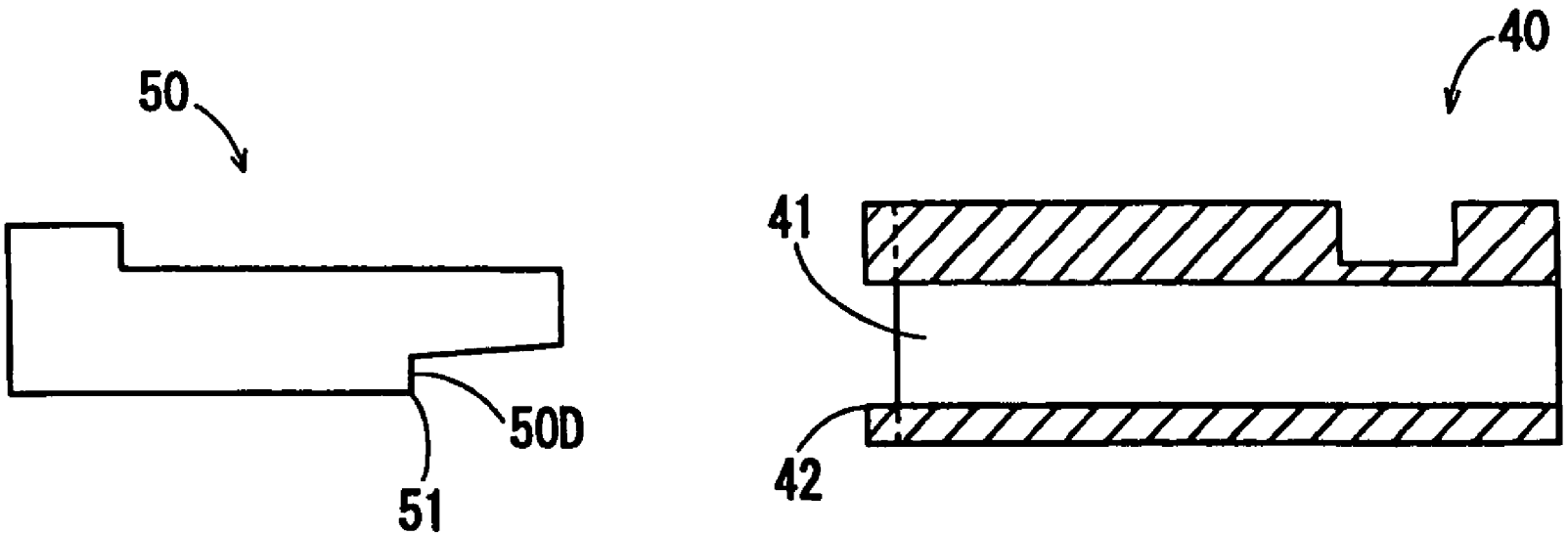

[Fig. 7]
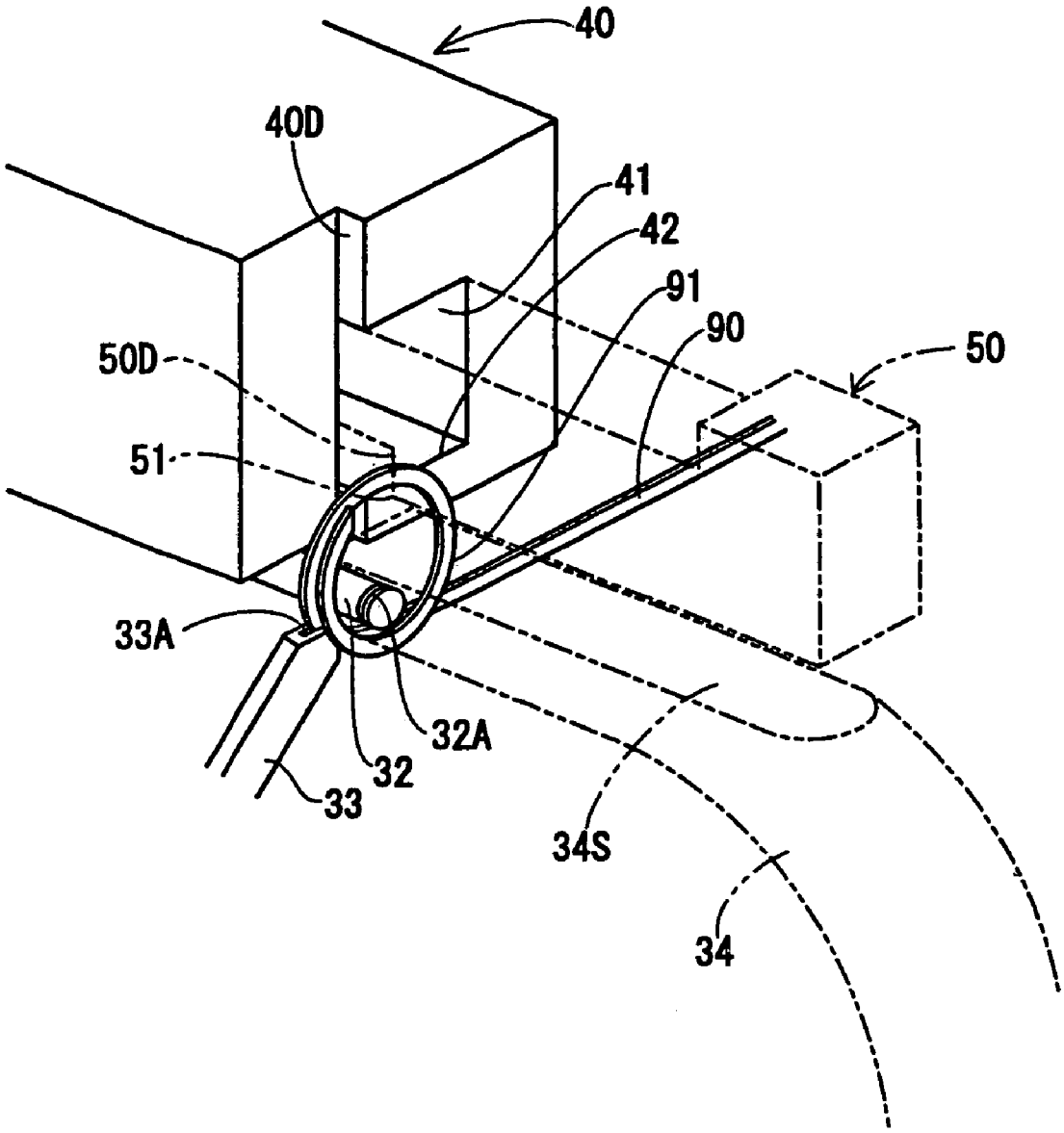

[Fig. 8]
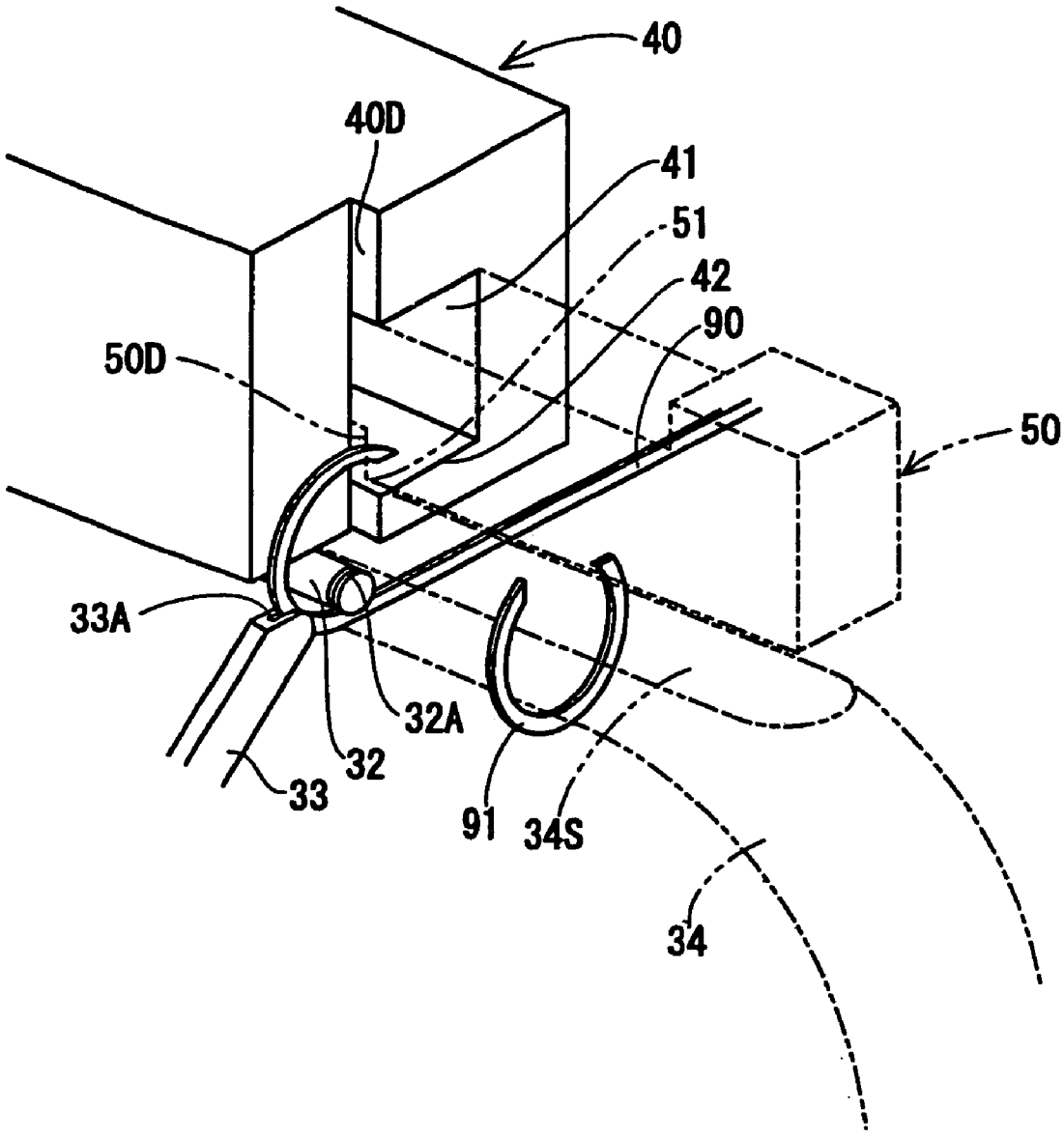

[Fig. 9]
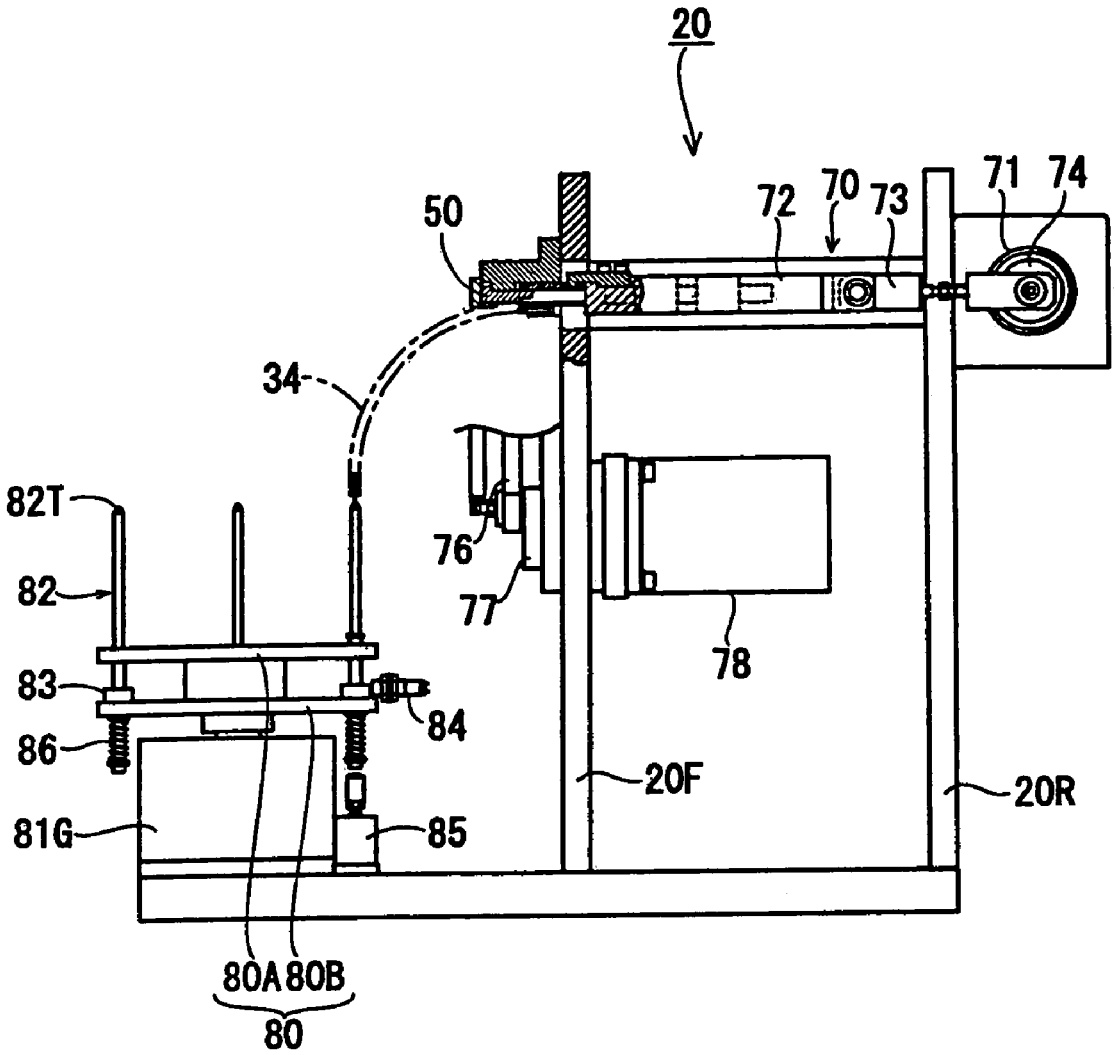

[Fig. 10]
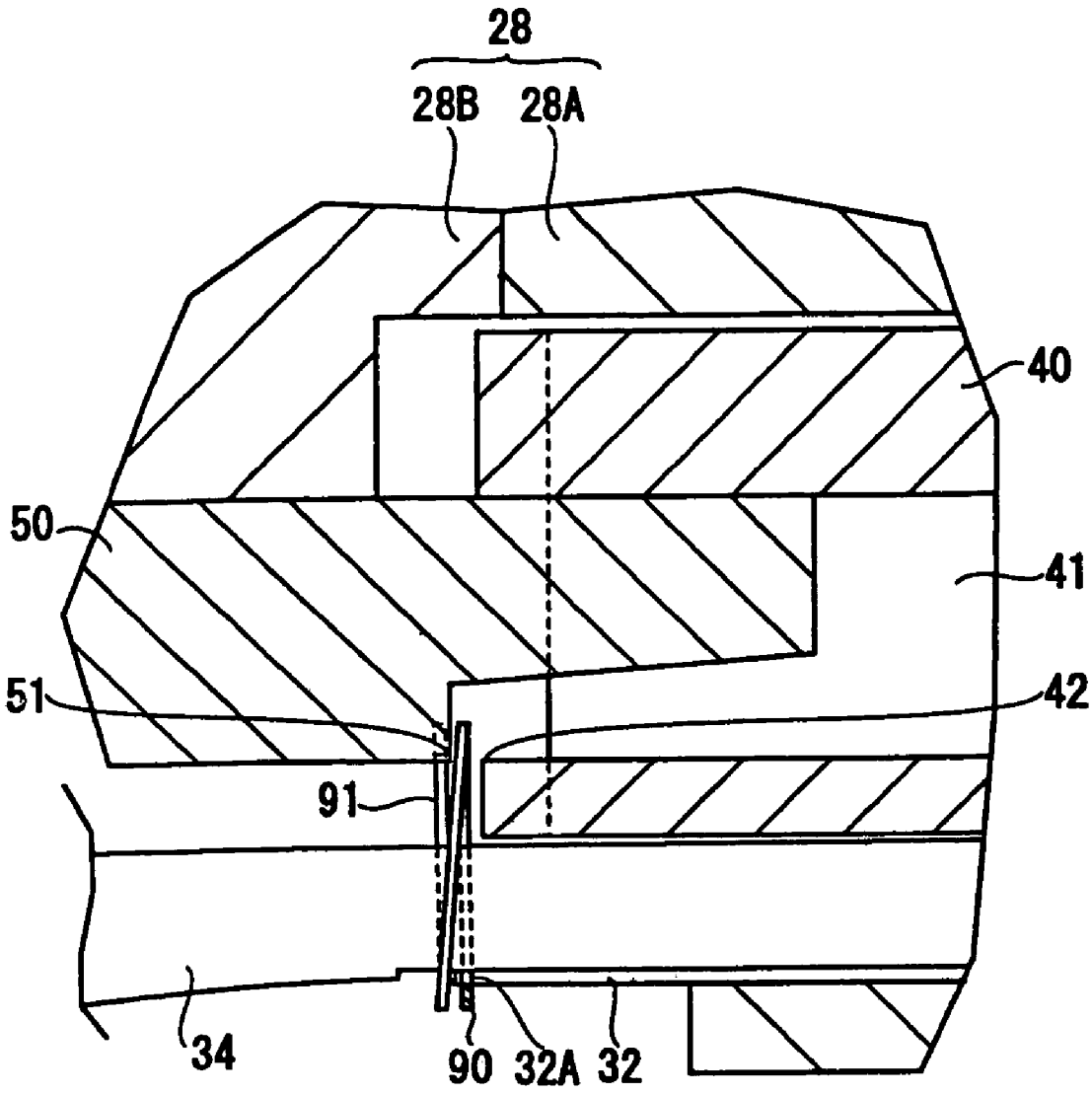

[Fig. 11]
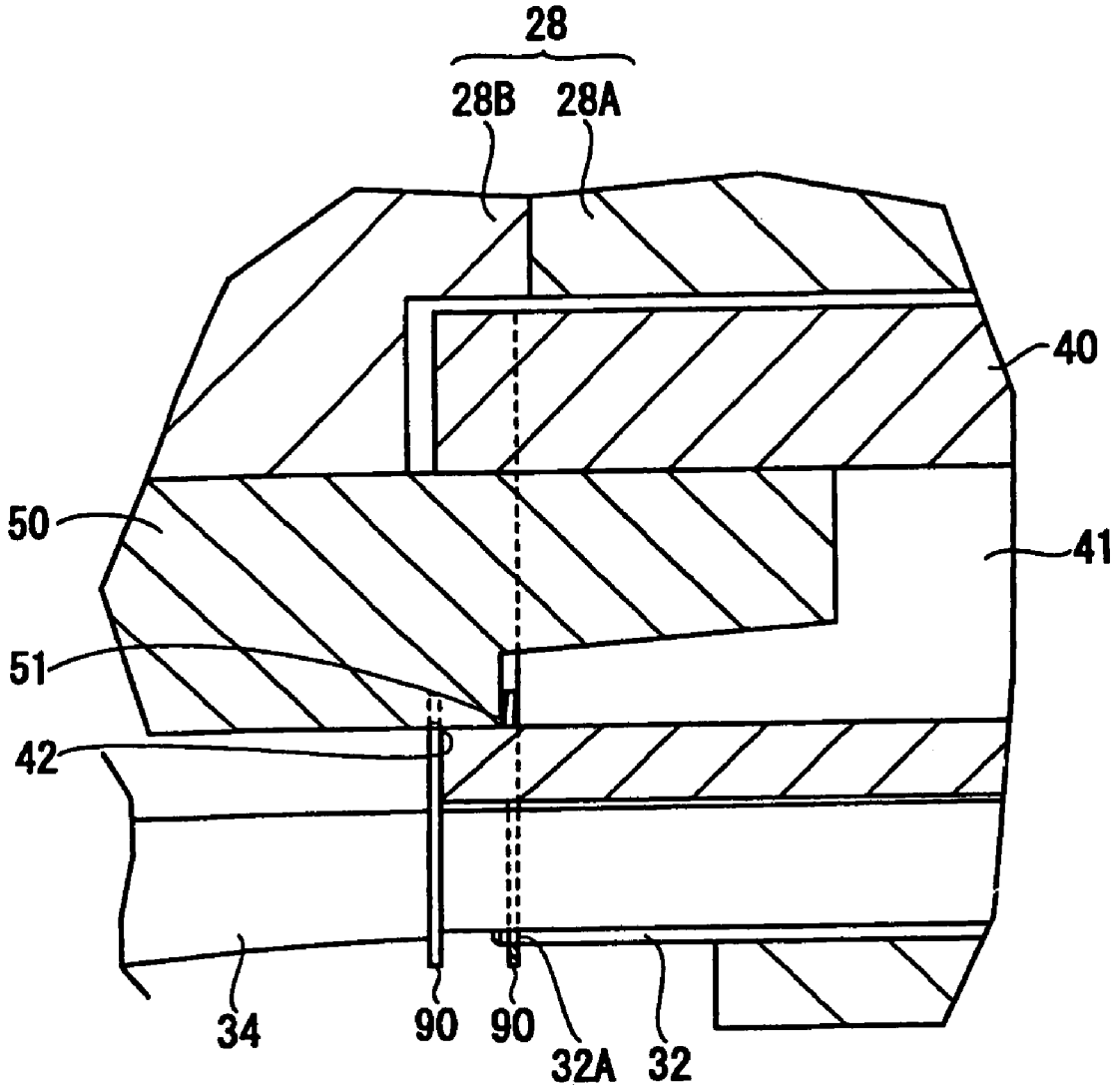

[Fig. 12]
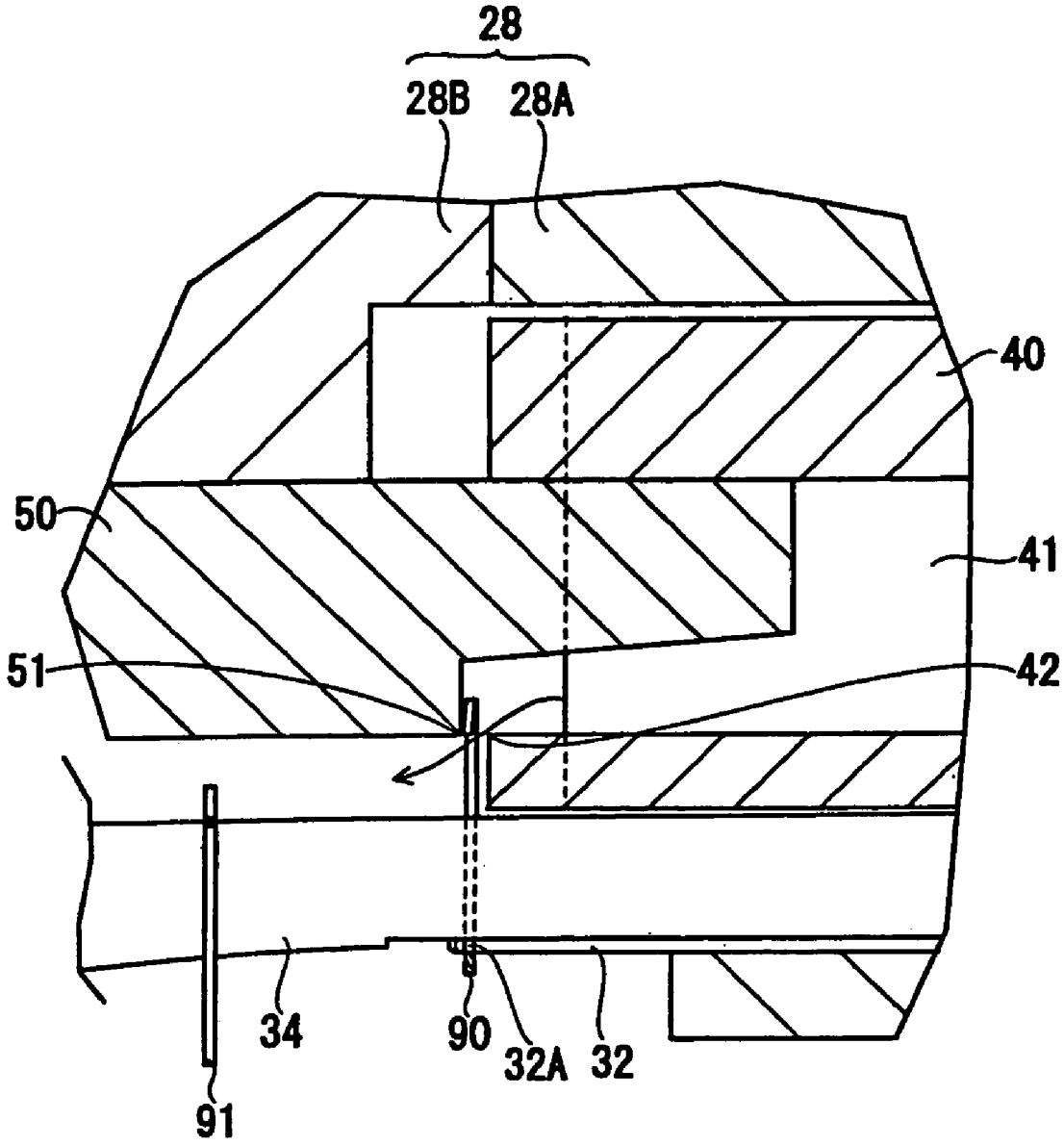

[Fig. 13]
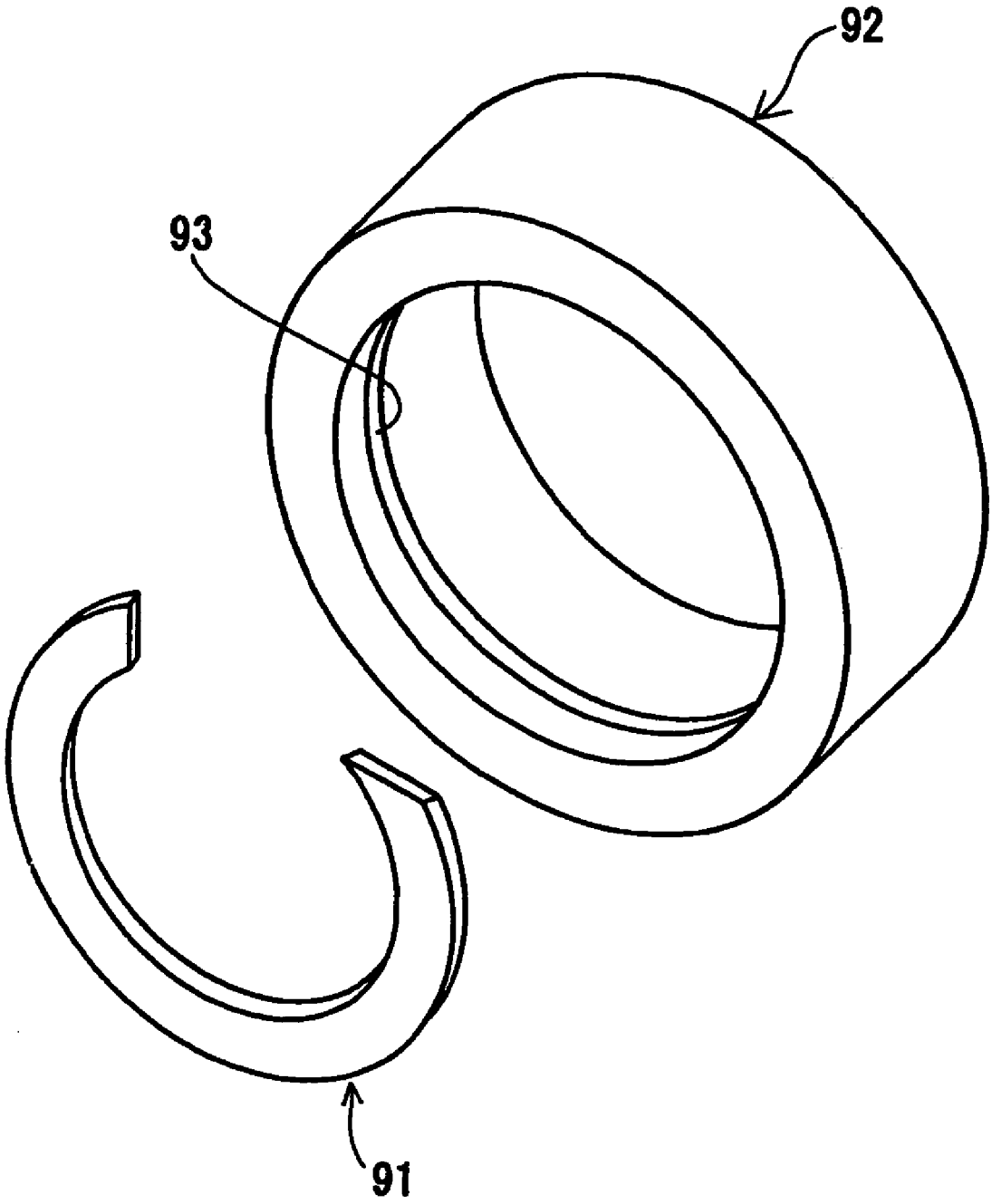

[Fig. 14]
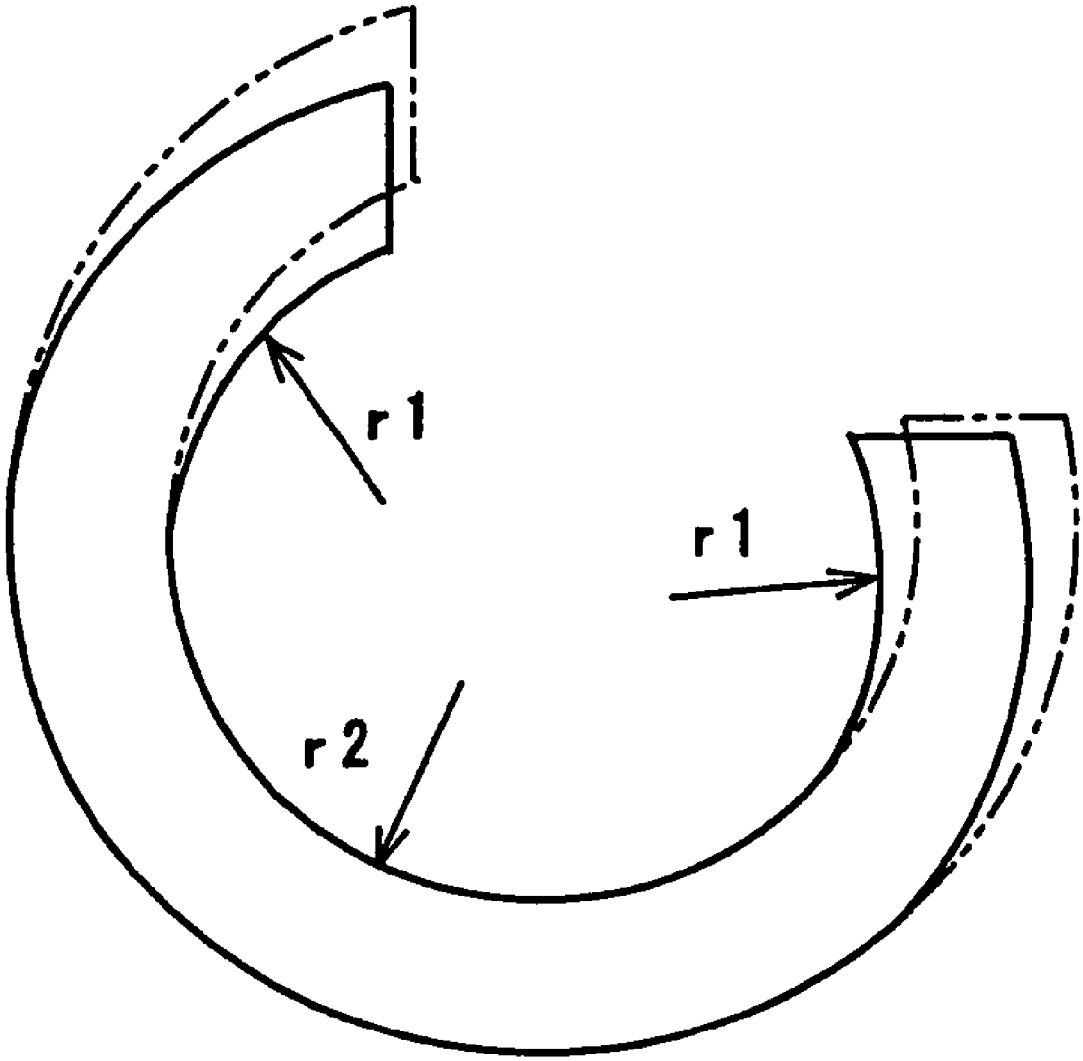

WIRE ROD-FORMING MACHINE

CROSS-REFERENCE TO RELATED APPLICATIONS

This application claims priority from Japanese Patent Application No. 2002-342699 filed on Nov. 26, 2002.

BACKGROUND OF THE INVENTION

1. Field of the Invention

The present invention relates to a wire rod-forming machine that shapes wire rods into rings or coil springs and other ring-shaped wire rod parts.

2. Description of the Related Art

As a wire rod-forming machine of the prior art, those that form rings from a wire rod are publicly available in the literature (for example, see patent reference 1). In this wire rod forming machine, by feeding a wire rod while pushing it against a forming guide, a ring is formed from the wire rod, and the ring is cut off from the wire rod by sectioning a prescribed location of the wire rod with a cutter (sectioning means).

In addition, the concrete structure of the cut off means is not disclosed for this wire rod forming machine, however, in general cut off means, the constitution is such that the wire rod is pinched and sheared between the respective edges of a fixed die and a moveable punch is installed on the wire rod forming machine.

Now, in the wire rod forming machine, since the rings are formed in succession according to the feeding speed of the wire rod, in order to increase production speed, it is necessary to rapidly remove from the forming means the ring that is cut off from the wire rod, and to prevent it from becoming an obstacle for forming the next ring. However, in a wire rod-forming machine of the prior art, since the constitution was such that the ring that is cut off from the wire rod is allowed to fall naturally for removal from the forming means, it [the machine] was not appropriate for accelerating production speed.

SUMMARY OF THE INVENTION

Realizing the problems present in the prior art, the present invention has as its objective to provide a wire rod-forming machine that can increase the production speed beyond that of the prior art.

The wire rod forming machine, achieves the objective [icreased production speed], has a constitution in which, in a wire rod forming machine provided with a forming means that shapes into a ring or a coil spring and other ring-shaped wire rod part a wire rod that is fed, and a cut off means to cut off the ring-shaped wire rod part from the wire rod, the cut off means consisting of the provision of a moveable cutting member that moves two-ways between a starting point and an end point aligned in the horizontal direction and a holding sectioning member that is crossed by the moveable cutting member half-way through moving from the starting point to the end point, at the same time, shearing a prescribed location of the wire rod between the respective edges of these moveable culling member and holding sectioning member and cutting off the ring-shaped wire rod part from the wire rod, the moveable cutting member moving the ring-shaped wire rod part that is cut off to the end point.

In the wire rod forming machine, the holding sectioning member is a fixed punch that is fixed to the main body of the wire rod forming machine, and the moveable cutting member is provided with a punch hole into which the fixed punch protrudes and is a moving die that translates with respect to the main body of the wire rod forming machine.

In the wire rod forming machine, the constitution is such that a shaft shaped chute is provided, which is pushed through the inner side of the ring-shaped wire rod part, the ring-shaped wire rod part is formed from the wire rod by winding around the starting end portion of that shaft shaped chute, and, the ring-shaped wire rod part that is cut off from the wire rod is pushed toward the end portion side of the shaft shaped chute by the moveable cutting member.

In the wire rod forming machine, a supply route for compressed air is provided to move the ring-shaped wire rod part that is cut off from the wire rod to the end portion side of the shaft shaped chute.

In the wire rod forming machine, within the moving die serving as the moveable cutting member, the punch hole that is penetrated by the fixed punch serving as the holding sectioning member serves as the supply route for compressed air.

In the wire rod forming machine, the constitution such that the shaft shaped chute adopts an arc shape in which the starting end portion is oriented in the horizontal direction and the end portion is oriented in the lower direction. A rotation table is installed in the lower region of the shaft shaped chute, a plurality of shaft shaped magazines are erected oriented in the upper direction from the rotation table, and at the same time, any of the shaft shaped magazines is placed in the line extending the shaft shaped chute according to the rotation phase of the revolution table. A rotation table control means is installed, which rotates the rotation table such that a different shaft shaped magazine is placed in the line extending the shaft shaped chute when the ring-shaped wire rod parts passing through the shaft shaped chute and collected by the shaft shaped magazine reach a prescribed quantity.

In the wire rod forming machine, the tip portion of the shaft shaped magazines formed into a pointed shape, a concave portion is provided on the end face of the end portion of the shaft shaped chute, and a push up means is provided on the rotation table, pushing up the shaft shaped magazines placed on the line extending the shaft shaped chute in the upper direction and plunges the tip portion the shaft shaped magazines into the concave portion of the shaft shaped chute to connect these shaft shaped magazines and the shaft shaped chute.

In the wire rod forming machine, the constitution is such that a pressing roller is provided half-way through the supply route of the wire rod, the wire rod is passed through the pressing roller and rolled from a cross sectional round shape into a belt-shaped wire rod, and the ring-shaped wire rod part is formed by winding in a state where the width face of that belt-shaped wire rod is oriented in the direction of the winding axis.

In the wire rod forming machine, the constitution is such that a feeding roller is installed in order to feed the belt-shaped wire rod that is passed through and rolled by the pressing roller to the forming means, the belt-shaped wire rod is relaxed in the lower direction between the feeding roller and the pressing roller, and that relaxing portion is passed between a pair of touch sensors, and based on the detection signal of each touch sensor, the rotation number of the pressing roller is regulated such that relaxing of the belt-shaped wire rod is constant between these touch sensors.

In the wire rod forming machine, the ring-shaped wire rod part is a ring obtained by winding once the wire rod and whose two extremities are facing with a prescribed gap a translation tool is installed on the forming means, which renders modifiable the curvature of the ring by translating in the direction of the diameter of the ring, the curvature of the portions near both extremities of the wire rod that constitutes the ring is large so that the ring is closer to a true circle when it is deformed by the compression of the diameter via operation of the translation tool.

BRIEF DESCRIPTION OF THE DRAWINGS

FIG. 1 is a front view of the ring-forming machine that is one configuration the present invention.

FIG. 2A is a plane view of the guide unit.

FIG. 2B is a side view of the guide unit.

FIG. 3 is a plane view of a feeding roller.

FIG. 4 is a partially magnified front view of the forming machine's main body in the A—A cross-sectional plane of FIG. 5.

FIG. 5 is a partially magnified side cross sectional view of the forming machine's main body FIG. 6 is a side cross sectional view of a fixed punch and a moving die.

FIG. 7 is a perspective view of the situation in which a ring is formed from the belt-shaped wire rod.

FIG. 8 is a perspective view of the state in which the ring has been cut off.

FIG. 9 is a side view of a forming machine's main body.

FIG. 10 is a side cross sectional view of a forming machine's main body in a situation where the moving die is located at the starting point.

FIG. 11 is a side cross sectional view of a forming machine's main body in a situation where the moving die is located at the end point.

FIG. 12 is a side cross sectional view of a forming machine's main body in a situation where the ring was pushed with compressed air.

FIG. 13 is a perspective view of a ring and a tube.

FIG. 14 is a front view of a ring.

DETAILED DESCRIPTION

In the wire rod forming machine, a wire rod that is fed is pushed against a forming means and shaped into a ring or a coil spring and other ring-shaped wire rod part. Then, between the respective edges of the moveable cutting member and the holding sectioning member that constitute the sectioning means, a prescribed location of the wire rod is sheared and a ring-shaped wire rod part is cut off from the wire rod. In so doing, the ring-shaped wire rod part that is cut off moves, pushed by a moveable cutting member, and is forcibly removed from the forming means. In this way, the speed of removal of ring-shaped wire rod parts can be coupled to the acceleration of the manufacturing speed and increased, allowing production speed to be improved compared to that of the prior art.

In addition, as a concrete constitution of the cut off means, the constitution may be such that the wire rod is sectioned between a fixed punch and a moving die.

In the wire rod-forming machine, the ring-shaped wire rod part that is cut off from the wire rod is pushed by a moveable cutting member and moves to the end portion side of a shaft shaped chute. In this way, the ring-shaped wire rod part is collected at the end portion of the shaft shaped chute, and transport to the next process becomes easy.

In the wire rod-forming machine, the ring that is cut off from the wire rod-shaped wire rod parts is pushed by compressed air, removed smoothly from the forming means and collected at the end portion of the shaft shaped chute. Here, if, within the moving die, the punch hole into which the fixed punch penetrates serves also as a route for supplying compressed air, a constitution can be achieved, which is more compact than in a situation where a supply route is installed separately.

In the wire rod-forming machine, ring-shaped wire rod parts pass through a shaft shaped chute shaft and are collected by a shaped magazine. Then, when a prescribed quantity of ring-shaped wire rod parts, collected by the shaft shaped magazine, is reached, a rotation table rotates and a different shaft shaped magazine is placed in the line extending from the shaft shaped chute, such that ring-shaped wire rod parts are collected by that shaft shaped magazine. In this way, a prescribed quantity of ring-shaped wire rod parts can be collected by a plurality of shaft shaped magazines.

In the wire rod-forming machine, a pointed tip portion of a shaft shaped magazine plunges into the concave portion the end portion the shaft shaped chute, to couple the shaft shaped magazine and the shaft shaped chute, allowing transfer of the ring-shaped wire rod parts from the shaft shaped chute to the shaft shaped magazines to be performed smoothly.

With a pressing roller, as in the wire rod-forming machine, it is permissible that the pressing roller rolls the wire rod having a cross-sectional round shape into a belt-shaped wire rod. Then, the ring-shaped wire rod is formed by winding in a state where the width face of that belt-shaped wire rod is oriented in the direction of the winding axis.

With the wire rod-forming machine, since a relaxing portion of the belt-shaped wire rod is provided between the feeding roller and the pressing roller, it is possible to absorb the difference in feeding speed between the feeding roller and the pressing roller. In addition, the degree of relaxation of the belt-shaped wire rod is detected with touch sensors. By regulating the rotation number of the pressing rollers based on the detection signals of these touch sensors, that degree of relaxation can be maintained constant. In this way, it is possible to stably feed the belt-shaped wire rod.

With the wire rod-forming machine, since the curvature of the portion near both extremities of the wire rod that constitutes the ring was enlarged by operating the translation tool installed on the forming means, the curvature can be brought close to a true circle, when the ring is mounted onto the companion part and deformed by diameter compression.

In the following, one configuration in which the present invention was applied to the ring-forming machine 10 will be explained while referencing FIG. 1 through FIG. 14. In FIG. 1, the entirety of the ring-forming machine 10 is shown. In the same figure, key 11 is a rolling machine; a pair of pressing rollers 12 and 12 is provided above and below so as to be aligned. In a state where the pressing roller 12 on the upper side is pressed oriented towards the lower side by applying pressure with a pneumatic piston 12P, these pressing rollers 12 and 12 rotate symmetrically. In this way, the wire rod pinched between the pressing rollers 12 and 12 can be rolled while feeding it from the right side to the left side of the same FIG.

Within the rolling machine 11, a pair of guide units 13 and 13 is installed on the side of the origin wire rod feeding the pressing rollers 12 and 12 to each guide unit 13. As shown enlarged in FIG. 2(A), a plurality of guide rollers 14 is provided aligned in 2 rows and at the same time, the guide roller 14 of each row is offset mutually in the direction of the rows and in a so called, staggered distribution. Then, a wire rod is pushed through and guided between the rows of the groups of these guide rollers 14. In addition, in the present configuration, the guide unit 13 that is on the proximal of the pressing rollers 12 is installed with the axes of rotation of the guide rollers 14 oriented in the horizontal direction, and the guide unit 13 on the distal side is installed with the axes of rotation of the guide rollers 14 oriented in the vertical direction. Therefore, by the fact that the wire rod is passed through both of these guide units 13 and 13, the feeding route of the wire rod is positioned in both the horizontal direction and the up and down directions, and at the same time, curved wire rods are corrected into a straight state and guided to the pressing rollers 12 and 12.

The wire rod that is fed to the rolling machine 11 is provided from a reel stand that is not shown, and wound once to a drum 15. The wire rod that is wound to this drum 15 is a round wire rod having a round shape cross section, and by being passed through the guide units 13 and 13 and pulled in between the pressing rollers 12 and 12, is rolled into a belt-shaped wire rod 90 (see FIG. 7 and FIG. 8) and fed to a forming machine's main body 20. Here, the feeding route of the belt-shaped wire rod 90 in the forming machine's main body 20 is placed on the line extending nearly horizontally the feeding route of the belt-shaped wire rod 90 in the rolling machine 11 as shown in FIG. 1. Between the forming machine's main body 20 and the rolling machine 11, the belt-shaped wire rod 90 is relaxed in the lower direction. In addition, the lowest portion of that relaxing portion is passed in between a pair of touch sensors 16 and 16, and the rotation number of the pressing rollers 12 and 12 is regulated such that relaxing of the belt-shaped wire rod 90 is constant between these touch sensors 16 and 16. In this way, the offset in the feeding speed between the rolling machine 11 and the forming machine main body 20 is absorbed. In addition, the belt-shaped wire rod 90 is bent 90 degrees in the relaxing portion and pulled into the forming machine's main body 20 in a state where the wide surface is oriented in the horizontal direction.

The forming machine's main body 20 is provided with guide units 21 and 21, which have the same structures as the guide units 13 and 13 of the rolling machine 11, and a pair of feeding rollers 22 and 22 (see FIG. 3) is installed at the guide destination of the guide units 21 and 21. These feeding rollers 22 and 22 are in the horizontal direction, are aligned horizontally, and rotate symmetrically. Then, the belt-shaped wire rod 90 is pulled in between these feeding rollers 22 and 22.

The belt-shaped wire rod 90 that passed through the feeding rollers 22 and 22 passes through a nozzle 23. As shown in FIG. 1, within the forming machine's main body 20, a stabilization tool holding portion 25 is installed at the portion where the belt-shaped wire rod 90 is expelled from the nozzle 23. The stabilization tool holding portion 25 is fixed on the front face wall 20F of the forming machine's main body 20 and positioned in a direction that is lower than the nozzle 23. As shown in FIG. 4, from the top end face of the stabilization tool holding portion 25, an angular pillar shaped first forming tool 31 (corresponding to a "forming means" of the present invention) is erected oriented in the upper direction, and a groove 31A is formed at the front end of the first forming tool 31. Then, the belt-shaped wire rod 90, expelled from the nozzle 23, is directly extended in straight fashion, passing through the groove 31A. By being guided by the bottom face and the inner side faces of that groove 31A, the feeding route of the belt-shaped wire rod 90 is positioned with respect to the lower and lateral directions.

Within the forming machine's main body 20, a second forming tool 32 (corresponding to a "forming means" of the present invention) is installed more on the feeding destination side of the belt-shaped wire rod 90 than is the first forming tool 31 and on the side that is in the upper direction from the belt-shaped wire rod 90. As shown in FIG. 5, the second forming tool 32 has a shaft shape with a cross sectionally round shape and is fixed at the lower part of a block 28 that protrudes from the front face wall 20F of the forming machine's main body 20. Then, at the tip portion of the second forming tool 32, a groove 32A is formed around its entire circumference. The upper edge side of the belt-shaped wire rod 90 that passed through the first forming tool 31 passes through a portion of the groove 32A. In this way, the feeding route of the belt-shaped wire rod 90 is positioned with respect to the upper and lateral directions.

As shown in FIG. 1, within the front face wall 20F of the forming machine main body 20, at a position that is lower than the block 28, a guide 27 stretches in the oblique upper direction towards the block 28. Then, at a position near the upper end of the guide 27, a moveable tool holding portion 26 is supported so as to be translatable. One extremity of a link 76 is coupled to the inferior extremity portion of the moveable tool holding portion 26, and the other extremity of that link 76 is coupled to the rotating plate 77. The axis of the rotating plate 77 is supported by the rotation shaft of a motor 78 that is mounted from the rear face side of the front face wall 20F, as shown in FIG. 9, and the link 76 is coupled at a position eccentric from the rotation center of rotator 77. In this way, the moveable tool holding portion 26 translates with the motor 78 as the source of driving force.

As shown in FIG. 4, from the top face of the moveable tool holding portion 26, a third forming tool 33 (corresponding to a "forming means" of the present invention) with an angular pillar shape is erected towards the oblique upper direction, and a groove 33A is formed at the front end of the third forming tool 33. Here, the bottom face of the groove 33A of the third forming tool 33 is inclined such that the belt-shaped wire rod 90 which is positioned with respect to the up and down and lateral directions by the first and second forming tools 31 and 32, hits obliquely. Then, using the feeding rollers 22, the belt-shaped wire rod 90 is in sliding contact with the bottom surface groove 33A of the third forming tool 33 and the feeding direction is changed to the oblique upper direction. In this way, the belt-shaped wire rod 90 that passed through the third forming tool 33 is formed into a ring 91 (corresponding to the "ring-shaped wire rod part" of the present invention).

As shown in FIG. 5, the block 28 consists of a die guiding block 28A and a punch stabilization block 28B. The die guiding block 28A is fixed to the front face wall 20F of the forming machine's main body 20, and a punch fixing block 28B is fixed on the front face of that die guiding block 28A. Then, the ring 91 is cut off from the belt-shaped wire rod 90 by a fixed punch 50 (corresponding to the "holding sectioning member" of the present invention) and a moving die 40 (corresponding to the "moveable cutting member" of the present invention) assembled to this block 28.

Specifically, within the front face wall 20F of the forming machine main body 20, in the portion where the die guiding block 28A is fixed, a passage through hole 29 is formed, and at the same time, in the die guiding block 28A, a square hole 60 is formed, that communicates with the passage through hole 29. In addition, a translation mechanism 70 is provided on the depth side of the passage through hole 29, the base end side of the moving die 40 is fixed to a slider 72 described below of the translation mechanism 70, while the front-end side of the moving die 40 is fitted inside square hole 60.

The translation mechanism 70 is achieved by connecting one end of the link 73 to the end portion of the slider 72 supported by the forming machine's main body 20 so as to be translatable, and connecting the other end of that link 73 to the rotating plate 74, as shown in FIG. 9. The rotating plate 74 is rotated by a motor 71 that is fixed to the back face wall 20R of the forming machine's main body 20, and the other end of the link 73 is mounted at a position eccentric from the rotation center of the rotating plate 74. In this way, by the rotation of the rotating plate 74, the moving die 40 translates with the slider 72 and moves back and forth between the starting (see FIG. 10) and ending points (see FIG. 11).

The moving die 40 is shown in FIG. 6, and overall has an angular tube shape, and a punch hole 41 is made through in the direction of the shaft. As shown in FIG. 7, within the punch hole 41, on the front face of the moving die 40, a stepped portion 40D is provided along the rim of the opening that is on the side away from the nozzle 23 (see FIG. 4), and the side that is isolated from nozzle 23 by the stepped portion 40D is shunted towards the rear. As shown in FIG. 5, the back face of the moving die 40 is in tight contact with the front end face of the slider 72, and air vent 72A is formed in the slider 72, communicating with the punch hole 41 of the moving die 40. The air vent 72A stretches from one end that is relaxed inside the punch hole 41 to the inner side of the slider 72, and mid way is bent in the lower direction and released on the bottom surface of slider 72. Then, a tube, not shown, is mounted to the release opening on the bottom face of that slider 72, and compressed air that passes through that tube flows into the punch hole 41.

As shown in FIG. 5, a push through hole 61 communicating with the square hole 60 pierces through the punch stabilization block 28B in the front and back directions. The fixed punch 50 is inserted from the front face side into the push through hole 61 of the punch stabilization block 28B, and fixed on the stopping plate 62. This push through hole 61 releases the bottom face of the punch stabilization block 28B, and at the same time, the opening on the side facing the die guiding block 28A is broadened so that moving die 40 can penetrate.

The stabilization punch 50 is shown in FIG. 6. Overall it has an angular pillar shape and a stepped portion 50D is formed at a position near the inferior face at the front extremity, forming a pointed shape. As shown in FIG. 10 and FIG. 11, the front end of the fixed punch 50 is always penetrating in the punch hole 41 of the moving die 40. In addition, within the fixed punch 50, while the edge 51 of the bottom extremity angular side of the stepped portion 50D is positioned more in the front direction than in the front face of the moving die 40, when the moving die 40 is positioned at the starting point (situation of FIG. 10), it penetrates inside the punch hole 41, when the moving die 40 is positioned at the end point (situation of FIG. 11). Then, concomitant with the movement of the moving die 40, the edge 42 at the bottom edge in the aperture portion of the punch hole 41 and the edge 51 of the fixed punch 50 intersect, and the belt-shaped wire rod 90 is sheared between these two edges 42 and 51, and ring 91 is cut off from the belt-shaped wire rod 90.

As shown in FIG. 5, the starting end portion of the shaft shaped chute 34 is fixed at the bottom extremity of the die guiding block 28A. The shaft shaped chute 34 is achieved by curving an overall round rod into an arc shape, as shown in FIG. 7. Then, as shown in FIG. 9, while the starting end portion of the shaft shaped chute 34 rises in the perpendicular front direction from the front face wall 20F of the forming machine's main body 20, the end portion of the shaft shaped chute 34 is oriented in the vertical lower direction. In addition, as shown in FIG. 5, to avoid an interference with the moving die 40, the upper side portion of the starting end portion of the shaft shaped chute 34 is cut and is provided with an approximately horizontal plane 34S. In addition, on the bottom surface side of the starting extremity of the shaft shaped chute 34, a groove 34M is formed along the direction of the length, and in the interior of that groove 34M, the second forming tool 32 is housed by leaving a portion of its bottom surface side. Then, the belt-shaped wire rod 90 is formed into a ring 91 so as to wind around the starting extremity of this shaft shaped chute 34, and the ring 91, cut off from the belt-shaped wire rod 90, moves along the shaft shaped chute 34 so as to be separated from the front face wall 20F of the forming machine's main body 20.

As shown in FIG. 9, a rotation table 80 is installed in a direction lower than the end extremity of the shaft shaped chute 34. The rotation table 80 consists of the provision, for instance, of one pair of disks 80A and 80B that are facing in the up and down directions and fixed to the output shaft of a deceleration unit 81G, with 80 rotating in the horizontal plane. In addition, a motor 81 is coupled from the lateral direction to the deceleration unit 81G, as shown in FIG. 1, and this motor 81 is operated as a source of driving force.

A plurality of shaft shaped magazines 82 pierce through the peripheral edge of the rotation table 80 in the up and down directions. Each shaft shaped magazine 82 stretches in both the up and down directions of the rotation table 80. Within the shaft shaped magazine 82, the portion that is sandwiched between the disks 80A and 80B is provided with a flange shaped stopper 83 The shaft shaped magazine 82 moves vertically with the range where the stopper hits either of the 83 disks 80A and 80B as the stroke. Within the shaft shaped magazine 82, the portion that is in a lower direction than the disk 80B is pushed through a coil spring 86, biasing the shaft shaped magazine 82 to be always oriented towards the bottom extremity side of the stroke. Then, in a state where the shaft shaped magazine 82 is located on the lower extremity side, the upper end portion of the shaft shaped magazine 82 is positioned in a slightly lower direction than the shaft shaped chute 34, such that the rotation table 80 can be rotated without having these shaft shaped magazine 82 interfering with the shaft shaped chute 34. Then, according to the rotational phase of the rotation table 80, either of the shaft shaped magazines 82 is placed in the line extending the shaft shaped chute 34. In addition, in the lateral direction of the rotation table 80 the adjacent switch 84 is installed, at a position that faces, from the lateral direction, the shaft shaped magazine 82 placed in the line extending the shaft shaped chute 34.

In the lower direction from the rotating region of the shaft shaped magazine 82, a translation actuator 85 (corresponding to the "push up means" of the present invention) is installed in the line that extends the shaft shaped chute 34. This translation actuator 85 operates based on the detection signal from the adjacent switch 84, and pushes up the shaft shaped magazine 82, placed on the line extending shaft shaped chute 34 in the upper direction. In this way, the upper end of the shaft shaped magazine 82 is coupled to the end portion of the shaft shaped chute 34. Here, a pointed shape taper portion 82T is formed at the upper end of the shaft shaped magazine 82, and on the other hand, on the bottom end face of the shaft shaped chute 34, a concave site (not shown) is formed into a taper shape that contracts by moving inwards. The taper portion 82T plunges into the concave site, coupling the shaft shaped magazine 82 and the shaft shaped chute 34 in a centered state.

Next, movements related to the ring-forming machine 10 of the present configuration will be explained. When the ring forming machine 10 is started, the pressing rollers 12 and 12 of the rolling machine 11 pull in the round shape cross section wire rod from the rolling drum 15 and roll it, such that the belt-shaped wire rod 90 is fed to the forming machine's main body 20.

At the forming machine's main body 20, the feeding rollers 22 and 22 operate intermittently and pull in a prescribed length of the belt-shaped wire rod 90 and feed it to the side of the nozzle 23. Here, even if the feeding speed of the belt-shaped wire rod 90 due to the feeding rollers 22 and 22, and the feeding speed of the belt-shaped wire rod 90 due to the pressing rollers 12 and 12 of the rolling machine 11 differ, since the belt-shaped wire rod 90 is slack between the forming machine's main body 20 and the rolling machine 11, the difference in feeding speed can be absorbed.

In addition, in case the slack in the belt-shaped wire rod 90 exceeds a prescribed range due to the difference in the feeding speed between the feeding roller 22 and the pressing roller 12, the slack of the belt-shaped wire rod 90 is regulated to be constant between the pair of touch sensors 16 and 16, as indicated below. That is, if the slack of the belt-shaped wire rod 90 exceeds a prescribed range, the belt-shaped wire rod 90 contacts either of the a pair of touch sensors 16 and 16, through which the slack of the belt-shaped wire rod 90 passed through, and its detection signal is recognized by the control device of the ring forming machine 10.

The control device of the ring-forming machine 10, when it recognizes the detection signal of the touch sensor 16 on the lower side (in case the feeding speed of the pressing roller 12 is excessively large), either stops the pressing roller 12 for a prescribed time or lowers the rotational speed of the pressing roller 12. On the other hand, when it recognizes the detection signal of the touch sensor 16 from the upper side (in case the feeding speed of the pressing roller 12 is excessively small), it either stops the ring-forming machine 10 for a prescribed time or raises the rotational speed of the pressing roller 12. In this way, the supply speed of the feeding roller 22 and the feeding speed of the pressing roller 12 are adjusted automatically, to keep constant the slack of the belt-shaped wire rod 90.

In addition, the control of the belt-shaped wire rod may be performed as follows. That is, 2 speeds are set, i.e., a feeding speed V2*u*, the feeding speed of the belt-shaped wire rod 90 due to the pressing rollers 12 and 12 on the side of the rolling machine 11 is increased by a prescribed quantity with respect to a feeding speed V1 of the belt-shaped wire rod 90, due to the feeding rollers 22 and 22, and a feeding speed V2*d* that is reduced by a prescribed quantity. Then, when the belt-shaped wire rod 90 is in contact with the touch sensor 16 on the lower side, the pressing rollers 12 and 12 rotate with the feeding speed V2*d*, and when it is separated from the touch sensor 16 on the lower side, they rotate with the feeding speed V2*u*. In addition, when the belt-shaped wire rod 90 is in contact with the touch sensor 16 on the upper side, an abnormal extension force signal is sent out, stopping both the feeding rollers 22 and 22 and the pressing rollers 12 and 12.

In this way, during operation, when the feeding rollers 22 and 22 and the pressing rollers 12 and 12 are rotating together, when the belt-shaped wire rod 90 is between the upper and the lower touch sensors 16 and 16 and is not in contact with either touch sensors 16 and 16, the pressing rollers 12 and 12 rotate with the feeding speed V2*u*, and the belt-shaped wire rod 90 descends gradually, and finally is in contact with the touch sensor 16 on the lower side. When in contact, the feeding speed of the pressing rollers 12 and 12 is switched to V2*d*. After a while, the belt-shaped wire rod 90 rises and is separated from the touch sensor 16. The feeding speed of the pressing rollers 12 and 12 is switched to V2*u*, and the belt-shaped wire rod 90 starts descending again. By repeating this, the feeding speed of the pressing roller 12 is automatically adjusted with respect to the feeding speed V1 of the feeding roller 22, and the slack of the belt-shaped wire rod 90 is kept within a given limit.

The belt-shaped wire rod 90 that passed through the feeding rollers 22 and 22 is supplied oriented with its wide surface in the horizontal direction, as shown in FIG. 7. By passing through each groove 31A, 32A and 33A of the first through third forming tools 31, 32 and 33, the wire rod 90 is oriented towards the upper direction and deformed by curving. In so doing, the moving die 40 is positioned at the starting point, as shown in FIG. 10, and a portion of the belt-shaped wire rod 90, deformed by curving, as shown in FIG. 4 and FIG. 7, crosses one lateral edge and one bottom edge of the punch hole 41 in the moving die 40, and passes through the gap between the moving die 40 and the fixed punch 50. Then, the belt-shaped wire rod 90 is wound roughly 1.5 turns around the shaft shaped chute 34, and after a while, the condition becomes such that the front extremity of the belt-shaped wire rod 90 is hitting the outer side face of the fixed punch 50 (see FIG. 7 and FIG. 10). Here, within the belt-shaped wire rod 90 that runs roughly 1.5 turns around the shaft shaped chute 34, roughly ¾ turns from the tip portion worth of side belt-shaped wire rod 90 corresponds to the prescribed length that is fed by the feeding roller 22.

The control device of the ring forming machine 10, when feeding of the prescribed length of belt-shaped wire rod 90 has ended, moves the moving die 40 from the starting point to the end point. While the moving die 40 is moving to the end point, the edge 42 on the lower edge of the punch hole 41 in the moving die 40 and the edge 51 at the lower edge of the fixed punch 50 intersect. In this way, within the belt-shaped wire rod 90, the portion that crosses the lower edge of the punch hole 41 is sheared, and the ring 91 is cut off from the belt-shaped wire rod 90. In so doing, the belt-shaped wire rod 90 that crossed one lateral edge of the punch hole 41 escapes from being cut off by the gap generated between the stepped portion 40D of the moving die 40 and the stepped portion 50D of the fixed punch 50, as shown in FIG. 8.

The ring 91, which was cut off, is shown in FIG. 8 and FIG. 13. Here, the belt-shaped wire rod 90 that constitutes the ring 91, shown emphasized in FIG. 14, has a larger curvature (=1/r1, where r1 is the radius of curvature) of the portions near both extremities, where it was sectioned, than the curvature of the middle portion (=1/r2, where r2 is the radius of curvature). In other words, the belt-shaped wire rod 90 that constitutes the ring 91 is in a so-called apple shape, in which both sectioned extremities are curved in such a way that they engage on the inner side. Because it is formed into this apple shape, within the belt-shaped wire rod 90, when the portion corresponding to both edge portions of ring 91 passes through the third forming tool 33, the moveable tool holding portion 26 translates so as to approach the side of the second forming tool 32. When the middle portion of ring 91 passes through the third forming tool 33, the moveable tool holding portion 26 translates so as to be separated from the second forming tool 32. As a result of these translations, in ring 91, the curvature X of the portion near both extremities (=1/r1) is larger than the curvature of the middle portion (=1/r2).

Now, when cutting off the ring 91 from the belt-shaped wire rod 90, as shown in FIG. 11, ring 91 is pushed by the moving die 40 and removed forcibly from the forming tools 31, 32 and 33. In addition, since compressed air is provided in the punch hole 41 of the moving die 40, due to that compressed air, the ring 91 moves further along the shaft shaped chute 34 so as to be separated from the forming tools 31, 32 and 33 (FIG. 8 and see FIG. 12). Here, when the major portion of the fixed punch 50 disengages from the punch hole 41, while the moving die 40 is on its way back from the end point to the starting point, the compressed air from the punch hole 41 is blown more abundantly onto the ring 91, and the ring 91 moves farther from forming tools 31, 32 and 33.

The ring 91 that moved halfway through the shaft shaped chute 34, due to the compressed air, goes by gravity to the end portion of the shaft shaped chute 34. Then, it is pushed through the shaft shaped magazine 82 that is coupled to the shaft shaped chute 34.

By repeating the movements described above, the ring 91 is formed in succession from the belt-shaped wire rod 90. Here, when the ring 91 is cut off from the belt-shaped wire rod 90, it is simultaneously pushed by the moving die 40 and removed forcibly from the forming tools 31, 32 and 33. Then, in case the operating speed of the ring-forming machine 10 (that is, the production speed of ring 91) is raised, the ring 91 is removed at a speed coupled to that operating speed (production speed).

The ring 91 that is formed and cut off in succession from the belt-shaped wire rod 90 is stacked over in the upper and the lower directions along shaft shaped magazine 82. Here, as a "rotation table control means" related to the present invention, the control device of the ring-forming machine 10 is counting, for instance, the number of rings 91 manufactured. When that count number reaches a given amount and the rings 91 are pushed through the entirety of one shaft shaped magazine 82, forming of the ring 91 is temporarily halted, and the driving portion of the translation actuator 85 is lowered. Then, by the elastic force of the coil spring 86, the shaft shaped magazine 82 is lowered and separated from the shaft shaped chute 34.

Subsequently, the control device of the ring-forming machine 10 rotates the rotation table 80. By recognizing that a different shaft shaped magazine 82 has been placed in the line extending the shaft shaped chute 34, and based on the detection signal of the nearing switch 84, the control device pushes up the driving portion of the translation actuator 85, connects the empty shaft shaped magazine 82 to the shaft shaped chute 34, and resumes ring 91 formation.

As another method, when the number of rings 91 manufactured reaches a given amount, a stopper, not shown, advances towards the shaft shaped chute 34, and temporarily stops the ring 91 at the shaft shaped chute 34. Thereafter, the driving portion of the translation actuator 85 may be lowered. In this case, it is not necessary to interrupt ring 91 formation.

Now, to carry the rings 91 which have been stacked over the shaft shaped magazine 82 for next process, for example, a shaft body for carrying use (not shown), which has the same diameter as the shaft shaped magazine 82 is used. At the extremity face of that shaft body for carrying, a taper shaped concave site is formed, into which the taper portion 82T of the shaft shaped magazine 82 can protrude. Then, one end of the shaft body for carrying is joined to the upper end portion of the shaft shaped magazine 82, and with a Y-shaped tool, not shown, the group of rings 91 is transferred from the lower end of the shaft shaped magazine 82 to the shaft body for carrying in the upper direction. In addition, this shaft body for carrying, for example, is mountable on an assembling device (not shown) of the next process, and that assembling device takes the rings 91 one by one from the shaft body for carrying, and assembles them, for instance, on the inner side of a tube 92 shown in FIG. 13.

As shown in the same Fig., a ring-mounting groove 93 is formed on the inner face of the tube 92, and the ring 91 is deformed by diameter compression and pushed into the ring-mounting groove 93. It is fitted inside the ring-mounting groove 93 through elastic force. Here, when the ring 91 is deformed by diameter compression, rather than both edge portions, the middle portion of the belt-shaped wire rod 90, that constitutes the ring 91 is considerably deformed by diameter compression. However, in the present configuration, since the belt-shaped wire rod 90 that constitutes the ring 91 has a larger curvature in the direction of both extremities than in the middle, when assembled with the tube 92, it is in a state close to a true circle when deformed by diameter compression.

This completes the description of the constitution, operation and effects of the present configuration. The present invention is not restricted to the this configuration and for example, configurations such as those described in the following, are also included in the technical scope of the present invention, and in addition, a variety of modifications other than those mentioned below may be performed within a scope that does not depart from the invention's fundamentals.

(1) In the configuration, an example was explained; in which the present invention was applied to a ring-forming machine 10 that forms a ring 91 as a ring-shaped wire rod part. However, the present invention may also be applied to a spring forming machine that forms a coil spring as a ring-shaped wire rod part.

(2) In the configuration, the ring 91 was formed from the belt-shaped wire rod 90. However, the present invention may also be applied to a ring-forming machine that forms a ring from a wire rod with a round shape cross section.

(3) In the configuration, the punch hole 41 in the moving die 40 was used dually as a supply route for compressed air. However, the constitution may be one in which the supply route for compressed air is installed separately at a site other than the punch hole 41.

As mentioned above, in the ring-forming machine 10 of the present configuration, between the respective edges 42 and 51 of the moving die 40 and the fixed punch 50, a prescribed location of the belt-shaped wire rod 90 is sheared and the ring 91 is cut off from the belt-shaped wire rod 90. Then, by pushing the ring 91 that was cut off with the moving die 40, it is forcibly removed from the forming tools 31, 32 and 33. Therefore, the speed of removal of the ring 91 can be coupled to the acceleration in the manufacturing speed and increased, allowing the production speed to be improved compared to that of the prior art.

In addition, since the ring 91 that is cut off from the belt-shaped wire rod 90, pushed by the moving die 40, moves to the end portion side of the shaft shaped chute 34 to be collected, transport to the next process becomes easy.

In addition, the ring 91 can be pushed by compressed air and collected smoothly at the end portion of the shaft shaped chute 34. Moreover, since within the moving die 40, the punch hole 41 into which the fixed punch 50 penetrates serves equally as a supply route for compressed air, a constitution can be achieved, which is more compact than when a supply route is installed separately.

In addition, since the ring 91 passes through the shaft shaped chute 34 and is collected by the shaft shaped magazine 82, when a prescribed quantity of ring 91 is collected by that shaft shaped magazine 82, the rotation table 80 rotates to switch automatically to a different shaft shaped magazine 82, and the rings 91 are collected efficiently to a plurality of shaft shaped magazines 82.

What is claimed is:

1. A wire rod-forming apparatus, comprising:

a wire rod-forming machine body;

a means for shaping at least a part of a wire rod, fed into the wire rod-forming machine body, into a shaped part of at least one of a ring shape or a coil spring shape;

a cutting member, that swings from a starting point to an end point aligned in a horizontal direction in the wire rod-forming machine body, for cutting the wire rod to separate the shaped part from an unshaped part;

a holding member, that is crossed by the cutting member during swinging at a point that is half-way between the starting point; and a shaft-shaped chute which can be moved into a position along an inner side of the wire rod, and wherein once the wire rod is cut such that the shaped part is separated from the unshaped part, the holding member allows the shaped part to be moved, wherein once so moved the shaping of the wire rod is caused by winding the wire rod around the shaft-shaped chute, and wherein once the shaped part of the wire rod is cut off from the unshaped part, movement of the cutting member moves the shaped part toward an end side of the shaft-shaped chute.

2. The apparatus according to claim 1, wherein the wire rod is cut at a prescribed location between respective edges of the cutting member and the holding member.

3. The apparatus according to claim 1, wherein the holding member is a fixed punch connected to the wire rod-forming machine body.

4. The apparatus according to claim 3, wherein the cutting member is constructed as a die-cast that moves with respect to the wire rod-forming machine body and has a punch hole into which the fixed punch can protrude.

5. A wire rod-forming apparatus comprising:

a wire rod-forming machine body;

a means for shaping at least a part of a wire rod, fed into the wire rod-forming machine body, into a shaped part of at least one of a ring shape or a coil spring shape;

a cutting member, that swings from a starting point to an end point aligned in a horizontal direction in the wire rod-forming machine body, for cutting the wire rod to separate the shaped part from an unshaped part;

a holding member, that is crossed by the cutting member during swinging at a point that is half-way between the starting point and end point;

a shaft-shaped chute which can be moved into a position along an inner side of the wire rod;

a supply route for compressed air to move the shaped part of the wire rod cut off from the unshaped part to an end side of the shaft-shaped chute, and wherein once the wire rod is cut such that the shaped part is separated from the unshaped part, the holding member allows the shaped part to be moved wherein once so moved the shaping of the wire rod is caused by winding the wire rod around the shaft-shaped chute.

6. The apparatus according to claim 5, wherein the wire rod is cut at a prescribed location between respective edges of the cutting member and the holding member.

7. The apparatus according to claim 5, wherein the holding member is a fixed punch connected to the wire rod-forming machine body.

8. The apparatus according to claim 7, wherein the cutting member is constructed as a die-cast that moves with respect to the wire rod-forming machine body and has a punch hole into which the fixed punch can protrude.

9. A wire rod-forming apparatus, comprising:

a wire rod-forming machine body;

a means for shaping at least a part of a wire rod, fed into the wire rod-forming machine body, into a shaped part of at least one of a ring shape or a coil spring shape;

a cutting member, that swings from a starting point to an end point aligned in a horizontal direction in the wire rod-forming machine body, for culling the wire rod to separate the shaped part from an unshaped part;

a holding member, that is crossed by the cutting member during swinging at a point that is half-way between the starting point and end point, and wherein once the wire rod is cut such that the shaped part is separated from the unshaped part, the holding member allows the shaped part to be moved, wherein the cutting member is constructed as a die-cast that moves with respect to the wire rod-forming machine body and has a punch hole into which the holding member can protrude, and wherein within the die-cast the punch hole can serve as a supply route for compressed air.

10. The apparatus according to claim 9, wherein the wire rod is cut at a prescribed location between respective edges of the cutting member and the holding member.

11. The apparatus according to claim 9, wherein the holding member is a fixed punch connected to the wire rod-forming machine body.

12. A wire rod-forming apparatus, comprising:

a wire rod-forming machine body;

a means for shaping at least a part of a wire rod, fed into the wire rod-forming machine body, into a shaped part of at least one of a ring shape or a coil spring shape;

a cutting member, that swings from a starting point to an end point aligned in a horizontal direction in the wire rod-forming machine body, for cutting the wire rod to separate the shaped part from an unshaped part;

a holding member, that is crossed by the cutting member during swinging at a point that is half-way between the starting point and end point;

a shaft-shaped chute having an arc to its form, wherein a starting portion is oriented in the horizontal direction and an ending portion is oriented in a lower region;

a rotation table, installed in the lower region of the shaft-shaped chute;

a plurality of shaft-shaped magazines, positioned in the upper region away from the rotation table; and a rotation table controller, which rotates the rotation table such that a different shaft-shaped magazine is placed in a line extending the shaft-shaped chute when the shaped part of the wire rod passes through the shaft-shaped chute and is collected by the shaft-shaped magazine until such reaches a prescribed quantity, and wherein once the wire rod is cut such that the shaped part is separated from the unshaped part, the holding member allows the shaped part to be moved, and wherein, at the same time, any of the shaft-shaped magazines is placed in the line extending the shaft-shaped chute according to a rotation phase of the revolution table.

13. The apparatus according to claim 12 wherein a tip portion of the shaft-shaped magazines is formed into a pointed shape, a concave portion is provided on the end face of the end portion of the shaft-shaped chute, and a push up means is provided on the rotation table, which pushes up the shaft shaped magazines placed on the line extending the shaft shaped chute in the upper direction and plunges the tip portion the shaft shaped magazines into the concave portion of the shaft shaped chute to connect these shaft shaped magazines and the shaft shaped chute.

14. A wire rod-forming apparatus, comprising:

a wire rod-forming machine body;

a means for shaping at least a part of a wire rod, fed into the wire rod-forming machine body, into a shaped part of at least one of a ring shape or a coil spring shape;

a cutting member, that swings from a starting point to an end point aligned in a horizontal direction in the wire rod-forming machine body, for cutting the wire rod to separate the shaped part from an unshaped part;

a holding member, that is crossed by the cutting member during swinging at a point that is half-way between the starting point and end point;

a pressing roller is provided half-way through a supply route of the wire rod, and wherein once the wire rod is cut such that the shaped part is separated from the unshaped part, the holding member allows the shaped part to be moved, wherein the wire rod is passed through the pressing roller and rolled from a cross sectional round shape into a belt-shaped wire rod, and the ring-shaped wire rod part is formed by winding in a state where the width face of that belt-shaped wire rod is oriented in the direction of the winding axis, and wherein a feeding roller is installed in order to feed the belt-shaped wire rod that is passed through and rolled by the pressing roller to the forming means, the belt-shaped wire rod is relaxed in the lower direction between the feeding roller and the pressing roller, and that relaxing portion is passed between a pair of touch sensors, and based on the detection signal of each touch sensor, the rotation number of the pressing roller is regulated such that relaxing of the belt-shaped wire rod is constant between these touch sensors.

* * * * *